United States Patent [19]

Kindred

[11] 4,172,427

[45] Oct. 30, 1979

[54] WATER PROPULSION UNIT INCLUDING FIN HAVING FOIL AND FLEXIBLE ENDS

[76] Inventor: William B. Kindred, 14659 Horger, Allen Park, Mich. 48101

[21] Appl. No.: 868,949

[22] Filed: Jan. 12, 1978

[51] Int. Cl.[2] ..... B63H 1/36

[52] U.S. Cl. ..... 115/28 R; 115/21; 403/233; 403/242; 403/388; 416/81; 416/83; 416/240

[58] Field of Search ..... 9/347, 301, 309, 13; 244/11, 22; 115/21, 22, 25, 26, 28 R, 29, 30; 403/388, 390, 391, 242, 244, 233, 263, 234, 347; 308/238; 416/132 A, DIG. 3, 81, 232, 83, 240, 227 A, 241 A

[56] References Cited

U.S. PATENT DOCUMENTS

| | | | |
|---|---|---|---|
| 1,261,213 | 4/1918 | Clay | 403/233 |
| 1,522,964 | 1/1925 | Meadowcroft | 403/234 X |
| 3,046,040 | 7/1962 | Luper | 403/388 |
| 3,056,980 | 10/1962 | Holladay | 9/13 X |
| 3,080,824 | 3/1963 | Boyd et al. | 416/132 A |
| 3,082,442 | 3/1963 | Cousteau et al. | 9/309 |
| 3,110,283 | 11/1963 | Warner | 115/29 |
| 3,304,136 | 2/1967 | Muller | 308/238 X |
| 3,695,211 | 10/1972 | Gross | 115/28 R X |
| 3,776,523 | 12/1973 | Weiland | 403/242 X |
| 3,850,545 | 11/1974 | Weir | 416/132 A |

*Primary Examiner*—Trygve M. Blix
*Assistant Examiner*—Sherman D. Basinger
*Attorney, Agent, or Firm*—Reising, Ethington, Barnard, Perry & Brooks

[57] ABSTRACT

A propulsion unit for driving water craft, particularly those of the floating lounge type, is disclosed as including a fin made from a flexible material with a first end formed to define a foil into which the lower end of an oscillatory drive member projects downwardly in a fixedly secured relationship and with a second flexible fin end that extends from the foil end to provide a flapping movement through the water upon oscillation of the drive member in order to propel the water craft. Movement of the drive member through the water is facilitated by the foil shape of the first fin end which is also more rigid than the second flexible end so as to increase the moment arm about the drive member where the flexible flapping movement is concentrated. Flexible sheet plastic is preferably used to form the fin with a folding operation at a score line to define the foil shape. A journal in the form of a tube receives an intermediate portion of the drive member to provide mounting thereof and is connected to the first end of a mounting bar which has a pair of spaced mounts for securing the unit to the frame of a water lounge. One of the mounts includes a saddle-like member and a cooperable fastener for securing the first end of the mounting bar to the frame. The other mount may include either a flattened hook shape portion of a second end of the mounting bar and a cooperable fastener or a flattened portion of the second mounting bar end which is inserted within a hole in the lounge frame. A foot actuator bar for the unit is secured to the upper end of the drive member either by a welded connection or a hollow T-shaped connector. Best results are achieved when the length of the flexible fin end is between about 1.4 and 1.8 times the length of the foil fin end.

16 Claims, 7 Drawing Figures

WATER PROPULSION UNIT INCLUDING FIN HAVING FOIL AND FLEXIBLE ENDS

BACKGROUND OF THE INVENTION

1. Field of the Invention

The present invention relates to a water propulsion unit for propelling water craft and which is particularly adaptable for use with a floating water lounge to provide driving thereof by foot power applied to the unit.

2. Description of the Prior Art

Most sailboats have a rear rudder which is rigid and can be used to propel the sailboat when it is becalmed. Back and forth manual movement applied to a tiller connected to the rudder pivots it so as to provide a movement that pushes the sailboat forwardly through the water.

In addition to the more conventional type of water craft like row boats, canoes, dinghies, and sailboats, etc., one recently introduced water craft is the floating water lounge that is designed for use not only in swimming pools but in lakes, rivers, etc., as well. These water lounges include a frame with a suitable covering such as interwoven webbing that provides the seating surface similar to an unfolded lawn lounge of the more well known type. Rigid foam members are secured to the water lounge frame in a suitable manner usually at each side and at one end where the frame is inclined upwardly to provide a backrest. In the past, the user of the water lounge moves his or her arms in a rowing manner to provide movement through the water. This movement is generally quite slow due to obstruction provided by the foam members at each side of the lounge as well as the problem of generating a sufficient propelling force with only one's hands. Also, steering of the water lounge in any particular direction is difficult for these same reasons.

SUMMARY OF THE INVENTION

An object of the present invention is to provide an improved propulsion unit for water craft in order to provide relatively efficient movement thereof through the water as well as the ability to provide good steering control of the direction of movement.

In carrying out the above object as well as other objects of this invention, the propulsion unit includes a fin made from a flexible material and including a first end formed to define a foil into which the lower end of an oscillatory drive member projects downwardly in a fixedly secured relationship to the fin. A second flexible end of the fin extends from the foil end and provides flexible flapping movement upon oscillation of the drive member so as to propel a water craft on which the unit is mounted. Movement of the lower drive member end through the water is facilitated by the foil end of the fin which receives the drive member and which rigidifies the fin adjacent the axis of oscillation so as to increase the moment arm thereabout where the flexible flapping movement of the fin is concentrated.

A flexible plastic sheet is preferably used to form the fin by providing a folded edge where the sheet extends back alongside itself and is secured at a peripheral edge to the adjacent side of the sheet. A score line which is preferably made by a round end mill operation facilitates the folding of the sheet at the edge which leads the fin through the water during operation of the propulsion unit. Any suitable means is used to secure the peripheral edge of the sheet to its one side in order to form the looped-shaped foil that receives the lower end of the drive member. Preferably, this securement is made by either a vibration or induction welding operation.

Good operation of the propulsion unit is achieved when the length of the flexible fin end is between approximately 1.4 and 1.8 times the length of the foil end of the fin. The preferred ratio for this relationship is 1.6 times with the foil being approximately 10 inches long and the flexible fin end being 16 inches long to give a total length of 26 inches. This of course means that the sheet of plastic used must be 36 inches long in order to provide the folded foil end. A fin height of 8 inches provides good propulsion force while still allowing operation of the unit in relatively shallow water. Polyethylene sheet plastic with a 3/16 inch thickness functions well with these dimensions.

The propulsion unit of this invention is particularly adaptable for use with a floating water lounge to provide propulsion thereof either in the direction opposite the direction the lounge occupant faces or in the same direction the occupant faces. Best performance of the unit takes place when the propulsion is in a direction opposite to the direction the occupant faces since the fin concentration of flexible flapping movement is then at a greater moment arm from the center of resistance of movement of the lounge.

A mounting bar of the propulsion unit has a first end connected to a journal that receives an intermediate portion of the drive member whose lower end is received within the foil end of the fin. An actuator foot bar is connected to the upper end of the drive member and has ends which extend in opposite directions thereof to permit the lounge occupant to oscillate the drive member by foot movement. Plastic bushings at upper and lower ends of the journal tube mitigate friction generaged during the driving of the fin by the lounge occupant's feet. First and second mounts connect the mounting bar to a frame of the lounge at first and second ends of the bar, the first end of which is located adjacent the journal tube. A saddle shaped member and a fastener of the first mount provide the connection adjacent the journal tube. The second mount in one embodiment includes a flattened hook portion of the second mounting bar end and a suitable fastener for providing the connection to the frame. In another embodiment the second mount includes a flattened portion of the second mounting bar end which is pointed to be received within a hole within the lounge frame. Both embodiments of the second mount secure the mounting bar at a spaced location from the first mount where the journal tube is located in order to provide a securely mounted unit.

One embodiment of the foot bar which actuates the oscillatory driving movement of the fin has a welded connection to the upper end of the drive member. A welded connection is also utilized to secure the journal tube to the first end of the mounting bar. Another embodiment of the foot bar for actuating the driving movement includes a hollow T-shaped connector with a stem that receives the upper end of the drive member and a cross portion that receives the foot bar. Suitable fasteners secure the T-shaped connector to the drive member and the foot bar. Fasteners are also utilized to provide securement of the foil fin end to the lower end of the drive member which projects downwardly into the water through the foil end.

The objects, features, and advantages of the present invention are readily apparent from the following detailed description of the preferred embodiment taken in connection with the accompanying drawings.

DETAILED DESCRIPTION OF THE PREFERRED EMBODIMENTS

Figure 1:
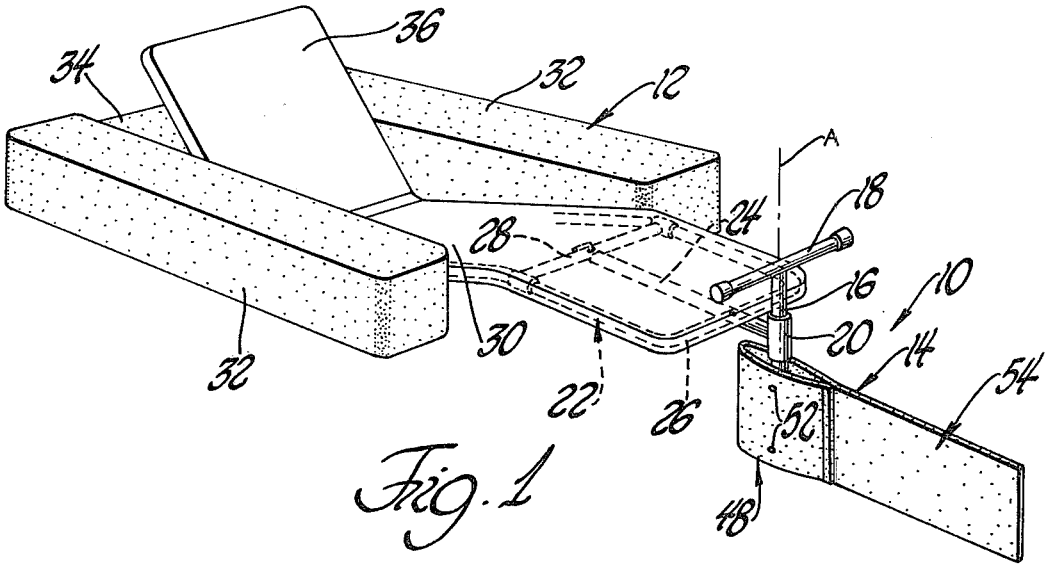
FIG. 1 is a perspective view of a water propulsion unit of this invention shown mounted on a water lounge to provide driving propulsion of the lounge in a direction opposite to the direction the lounge occupant faces.
Figure 2:
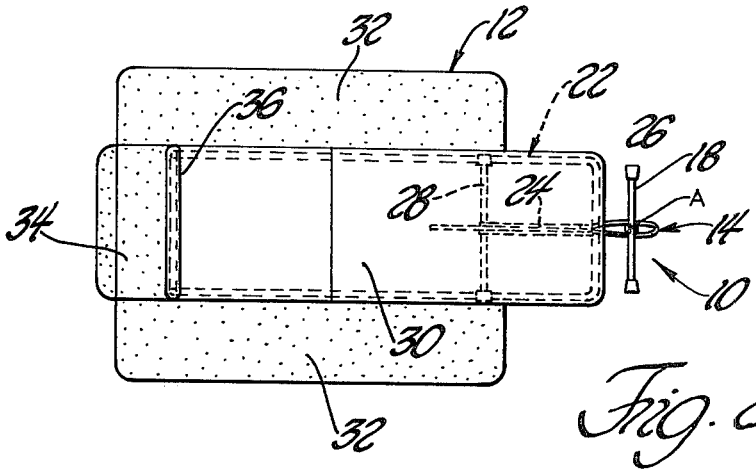
FIG. 2 is a top plan view of the lounge with the propulsion unit mounted thereon but oriented to provide driving propulsion in the same direction toward which the lounge occupant faces.

Referring to FIG. 1, a water propulsion unit constructed according to the present invention is indicated collectively by 10 and is shown mounted on a water lounge 12 to provide driving movement thereof in a manner that is more fully hereinafter described. A flexible fin 14 of the propulsion unit 10 is driven through a drive member 16 by way of an actuator in the form of a foot bar 18 connected to the drive member. Drive member 16 is supported along a generally vertical axis A by a journal in the form of a tube 20 that is connected to a frame 22 of the water lounge 12 by a mounting bar 24. The connection between the mounting bar 24 and the frame 22 is at spaced locations on an end cross frame member 26 and an intermediate cross frame member 28. During use the lounge occupant sits on a suitable frame covering 30 between foam floats 32 at each side of the lounge. Side floats 32 and an end foam float 34 are connected in a suitable manner to the lounge frame 22 so that the lounge occupant floats relatively high in the water while leaning back against an inclined backrest section 36. With the fin 14 extending rearwardly from the direction of oscillating driving movement as shown in FIG. 1, the lounge is propelled forwardly in a direction opposite to the direction toward which the occupant faces. This direction of movement provides the most efficient operation of the unit since the concentration of propelling force by the fin then has its greatest moment arm with respect to the area of maximum resistance to movement at the lower end of the backrest section 36 which is at the lowest point in the water. However, it should be understood that the propulsion unit 10 can also be used as shown in FIG. 2 with the fin 14 extending in the opposite direction as in FIG. 2 so that the lounge is propelled in the same direction the occupant faces.

Figure 5:
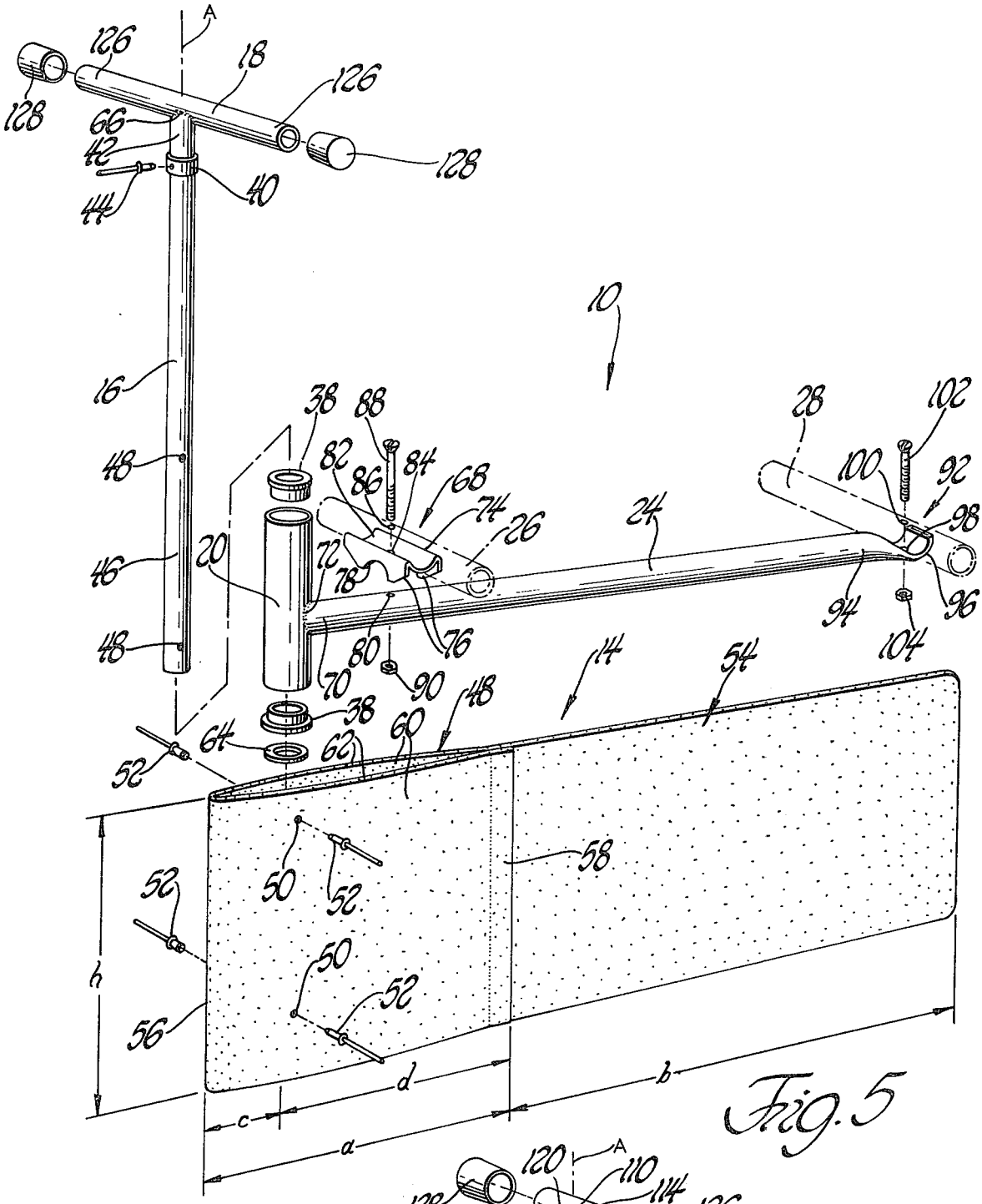
FIG. 5 is an exploded perspective view of the water propulsion unit.

An understanding of the propulsion unit 10 is best achieved by reference to FIG. 5 which shows the components thereof in an exploded condition prior to assembly. Drive member 16 has a tubular construction and is inserted downwardly through the journal tube 20 during assembly so that its intermediate portion is supported by a pair of annular plastic bushings 38 that are press fitted into the upper and lower ends of the tube. A stop 40 is secured in any suitable manner to the upper end 42 of the drive member such as by the pop rivet 44 so as to limit the downward insertion of the drive member through the journal tube 20. A lower end 46 of the drive member 16 projects downwardly from the journal tube 20 and is received within a foil 48 of a first end of the fin 14. Holes 48 in the lower drive member end 46 and holes 50 in the fin foil 48 receive associated pop rivets 52 that fixedly secure the fin foil to the drive member about the axis of oscillatory movement A. A second flexible end 54 of the fin 14 extends from the foil 48 away from the axis A of oscillation.

Figure 3:
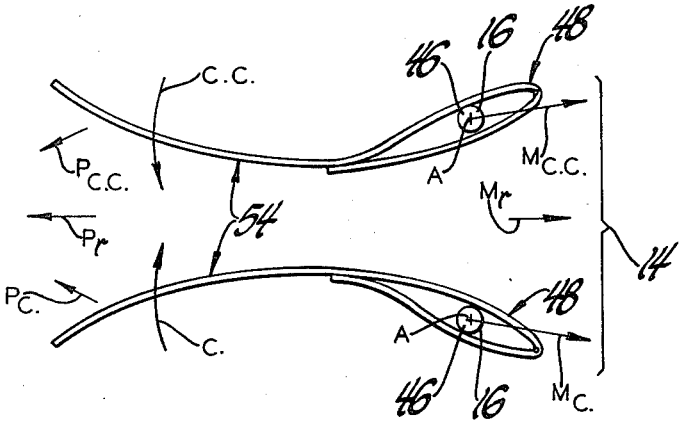
FIG. 3 is a schematic top plan view showing the manner in which a flexible fin of the propulsion unit provides driving propulsion through the water upon oscillatory driven movement.

Operation of the fin 14 as the drive member is oscillated about axis A is best understood by reference to FIG. 3 which shows the shape of the fin 14 during the counterclockwise portion of its cycle in the upper view and which shows the fin during the clockwise portion of its cycle in the lower view. During the resultant movement through the water shown by arrow Mr, the foil 48 of the fin facilitates the movement of the lower drive member end 46 through the water due to its location within the foil. Fin foil 48 is more rigid than the flexible fin end 54 and thereby concentrates the propelling force provided by the flexible fin end at a greater moment arm from the axis A of oscillation than would be the case without the more rigid foil. This allows the fin 14 to operate with shorter but more powerful strokes which propel the water lounge 12 on which the propulsion unit is mounted. During the counterclockwise portion of the oscillation as shown in the upper view of FIG. 3, the fin foil 48 is moved to the position shown and the flexible fin end 54 bends upwardly to the rear before straightening out and providing a propelling force along the direction shown by arrow Pc.c. This propelling force provides movement along a direction Mc.c. During the clockwise portion of the oscillation as shown in the lower view of FIG. 3, the foil 48 is moved to the position shown and the fin end 54 bends downwardly to the rear to provide a propelling force along the direction of arrow Pc. and movement along arrow Mc. The resultant propelling force is along the direction of arrow Pr to provide the resultant movement in the direction of arrow Mr.

Figure 6:
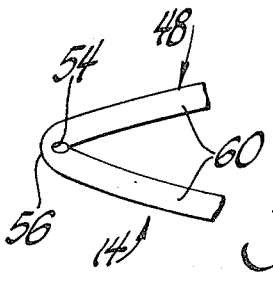
FIG. 6 is a partial top plan view of a folded leading edge of the fin.

The fin 14 herein disclosed is preferably made from a flexible plastic sheet by a folding operation. Polyethylene plastic 3/16 of an inch thick was used with the particular fin shown. A score line 54 was formed in the plastic sheet as shown in FIG. 6 by a round end mill so as to facilitate folding of the plastic sheet along its leading edge 56. A peripheral edge 58 of the sheet is secured to one side thereof as shown in FIG. 6 in any suitable manner such as by an induction or vibration weld so that the foil 48 is defined by an enclosed loop of the plastic sheet into which the lower drive member end 46 projects downwardly. The resultant folded plastic sheet thus has two curved sides 60 defining the foil 48 and extending on opposite sides of the lower drive member end 46 between leading and trailing junctions with each other. Upper edges 62 of the foil sides 60 engage a plastic washer 64 which slides against the lower plastic bushing 38 in the journal tube 20 so as to limit upward movement and prevent any wear of the fin during the oscillatory driving. The folded and peripheral edges 56 and 58 of the plastic sheet are located in opposite directions from the drive member end 46 after assembly.

Good driving movement is achieved when the length of the flexible fin end 54 indicated by distance b in FIG. 5 is between about 1.4 and 1.8 times the length of the foil 48 as shown by distance a. In the particular fin 14 shown made from the 3/16 inch thick polyethylene sheet, the foil 48 has a length a of 10 inches and the flexible fin end 54 has a length b of 26 inches. The distance b between the axis A of the drive member movement and the securement of the peripheral edge 58 to the one side of the plastic sheet is preferably about 3 times the distance c between the axis A and the leading folded edge 56 of the fin, i.e., 7.5 inches for dimension d and 2.5 inches for dimension c with the 10 inch long foil shown. Sufficient fin area for providing good propulsion is achieved when the height h of the fin is 8 inches while still allowing operation of the unit in relatively shallow water.

The embodiment of the water propulsion unit 10 shown in FIG. 5 has the upper end of its drive member 16 secured to an intermediate portion of the foot bar 18 by a weld 66 just above the stop 40 that limits downward movement of the drive member. A first mount 68 of this unit 10 is located adjacent a first end 70 of the mounting bar 24 which is secured to the journal tube 20 by a weld 72. Mount 68 includes a saddle-like member 74 with downwardly projecting legs 76 that have downwardly facing semicircular openings 78 for receiving the first mounting bar end 70 on the opposite sides of its hole 80. An upwardly opening semicircular intermediate portion 82 of member 74 extends between the legs 76 and has a hole 84 which is aligned with hole 80 in an assembled condition. Frame cross member 26 also has a hole 86 aligned with the other two holes and a fastener of the mount is comprised of a bolt 88 which is inserted through all of the aligned holes and a nut 90 that secures the bolt on the bottom side of the mounting bar. A second mount 92 is located at a second end 94 of the mounting bar which is flattened and bent to provide a hook portion 96 that receives the cross frame member 28 in a saddle-like manner. A hole 98 in the hook portion 96 and an aligned hole 100 in the frame member 28 receive a bolt 102 which is secured by a nut 104 on the bottom side of the mounting bar to cooperatively provide a fastener that secures the frame member to the mounting bar 24. With the mounting bar 24 secured to the water lounge by the first and second mounts 68 and 92, respectively, the fin 14 may be positioned as shown in either FIG. 1 or FIG. 2 to provide propulsion of the lounge.

Figure 4:
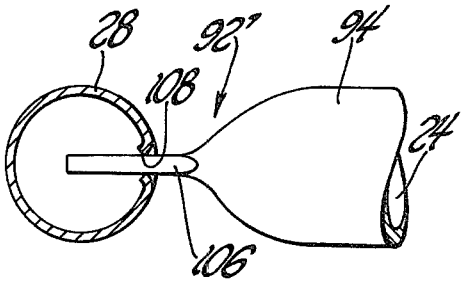
FIG. 4 is a partially sectioned view showing one mount which secures a mounting bar of the unit to a frame of the water lounge.

An alternate embodiment of the second mount is shown in FIG. 4 and indicated by reference numeral 92'. Second mounting bar end 94 in this embodiment has a flattened portion 106 which is pointed and inserted through a hole 108 in the cross frame member 28. No fastener is necessary with this particular form of the second mount since cooperation of the first mount provides for retention of the flattened portion 106 within the hole 108.

Figure 7:
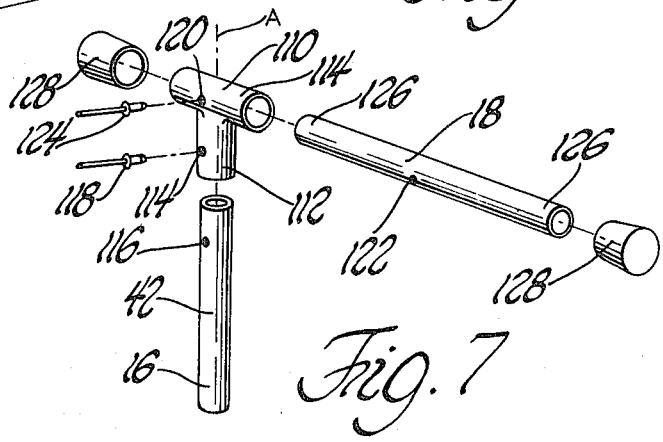
FIG. 7 is an exploded perspective view which shows an alternate way of connecting a foot bar for actuating driving movement to the upper end of a drive member that oscillates the fin.

An alternate manner of connecting the foot bar 18 to the upper end 42 of the drive member is shown in FIG. 7 and utilizes a hollow T-shaped connector 110 which has a lower stem 112 that receives the upper drive member end 42. A cross portion 114 of connector 110 receives the foot bar 18 which is inserted therethrough. A hole 114 in the connector stem 112 is aligned with a hole 116 in the upper drive member end and a pop rivet 118 is inserted therethrough to provide connection. Likewise, a hole 120 in the connector cross portion 114 and a hole 122 in the foot bar 18 are aligned with each other to receive a pop rivet 124 that provides connection.

Both the FIG. 5 and FIG. 7 embodiments of the foot bar 18 have the ends 126 thereof projecting in opposite directions from the upper drive member end 42 after assembly. Suitable caps 128 are pressed over the bar ends 126 to provide a smooth edge against which the lounge occupant can position his or her feet on the bar to provide the oscillation of the drive member 16. During use, this oscillation may take place about a longitudinal centerline of the lounge to provide straight ahead forward movement or about a line angled to the right or the left from the centerline in order to provide a turning movement. Turning can also be achieved during gliding by orienting the fin 14 in an appropriate direction.

While preferred embodiments of the water propulsion unit have herein been described in detail, those familiar with this art will recognize various alternative designs and embodiments for practicing the present invention as defined by the following claims.

What is claimed is:

1. A water propulsion unit comprising: a vertically extending drive member having upper and lower ends; mounting means that supports the drive member for oscillatory movement about a vertical axis and which is adapted to mount the unit on a water craft; an actuator on the upper end of the drive member for providing driving oscillation thereof; and a fin made from a flexible material and including a first end formed to define a foil into which the lower end of the drive member projects downwardly in a fixedly secured relationship thereto, said first foil end of the fin including curved sides having leading and trailing junctions with each other and extending therebetween in a spaced relationship to each other to receive the lower end of the drive member, the leading junction of the foil sides being spaced forwardly from the lower end of the drive member and the trailing junction being spaced rearwardly therefrom, said fin having a second flexible end that extends from the trailing junction between the sides of the first foil end to provide flexible flapping movement upon oscillation of the drive member so as to propel the water craft, the second flexible end of the fin extending from the first foil end with a length between about 1.4 and 1.8 times the length of the first foil end between the leading and trailing junctions of the sides thereof, and said first foil end of the fin facilitating movement of the lower drive member end through the water as well as rigidifying the fin adjacent the axis of oscillation so as to increase the moment arm about the drive member where the flexible flapping movement of the second fin end is concentrated.

2. A unit as in claim 1 wherein the fin is made from a flexible plastic sheet, the first foil end of the fin having a leading folded edge where the plastic sheet is folded to form a loop around the drive member, and the plastic sheet having a peripheral edge secured to one side of the sheet on the opposite side of the drive member from the leading folded edge of the fin.

3. A unit as in claim 2 wherein the plastic sheet includes a score line along the folded edge of the fin so as to facilitate the folding end formation of the foil around the drive member.

4. A unit as in claim 2 further including a weld that secures the peripheral edge of the sheet to said one side of the sheet so as to define the foil into which the drive member projects downwardly.

5. A unit as in claim 1 wherein the mounting means includes an elongated bar having a first end including a journal which supports the drive member, a pair of spaced mounts for securing the mounting bar to the frame of a floatable water lounge, and the actuator including a foot bar connected to the upper end of the drive member and having ends extending in opposite directions therefrom for foot driving that provides the oscillation of the drive member.

6. A unit as in claim 5 wherein a first one of the mounts is located at the first end of the mounting bar adjacent the journal and the mounting bar including a second end at which the second mount is located.

7. A unit as in claim 6 wherein the first mount includes a saddle-like member and a fastener for securing the first mounting bar end to a frame of the lounge, and the second mount including a flattened hook portion of the second mounting bar end and a fastener for securing the hook portion to the lounge frame at a spaced location from the first mount.

8. A unit as in claim 6 wherein the first mount includes a saddle-like member and a fastener for securing the first mounting bar end to a frame of the lounge, and the second mount including a flattened portion of the second mounting bar end which is formed into a pointed shape that is adaptable to be received within a hole in the lounge frame at a spaced location from the first mount.

9. A unit as in claim 5 wherein the foot bar includes an intermediate portion that is welded to the upper end of the drive member.

10. A unit as in claim 5 further including a T-shaped hollow connector having a stem that receives the upper end of the drive member and a cross portion that receives the foot bar, and fasteners that secure the connector to the drive member and the foot bar.

11. A unit as in claim 5 wherein the journal includes a vertically extending tube welded to the first end of the mounting bar, and the journal also including upper and lower plastic bushings received by the journal tube and supporting the drive member to mitigate friction during oscillatory driven movement thereof actuated by the foot bar.

12. A propulsion unit for a floatable water lounge having a frame to which the unit is adapted to be connected, the propulsion unit comprising: a vertically extending drive member having upper and lower ends; mounting means including a journal tube that supports the drive member for oscillatory movement about a vertical axis and a mounting bar connected to the journal tube and having a pair of mounts for securing the unit to the frame of the lounge; a foot operated actuator bar on the upper end of the drive member for providing driving oscillation thereof; and a fin made from a flexible plastic and including a first end formed to include an elongated loop defining a foil that receives the lower end of the drive member in a fixedly secured relationship thereto, said first foil end of the fin including curved sides having leading and trailing junctions with each other and extending therebetween in a spaced relationship to each other to receive the lower end of the drive member, the leading junction of the foil sides being spaced forwardly from the lower end of the drive member and the trailing junction being spaced rearwardly therefrom, said fin having a second end that extends from the first end thereof to provide flexible flapping movement upon oscillation of the drive member so as to propel the water lounge, said first foil end of the fin facilitating movement of the lower drive member end through the water as well as rigidifying the fin adjacent the axis of oscillation so as to increase the moment arm about the drive member where the flexible flapping movement of the second fin end is concentrated, and the flexible end of the fin extending from the trailing junction of the foil sides with a length between about 1.4 and 1.8 times the length of the foil-shaped fin end between the leading and trailing junctions of the sides thereof.

13. A propulsion unit for a floatable water lounge having a frame to which the unit is adapted to be connected, the propulsion unit comprising: a vertically extending drive member having upper and lower ends; mounting means including a journal tube that supports the drive member for oscillatory movement about a vertical axis and a mounting bar connected to the journal tube and including a pair of mounts for securing the unit to the frame of the lounge; a foot operated actuator bar on the upper end of the drive member for providing driving oscillation thereof; and a fin made from a flexible plastic sheet and including a first end folded to include an elongated loop that receives the lower end of the drive member in a fixedly secured relationship thereto, the plastic sheet including a score line at which the first end of the fin is folded to provide a leading edge of the fin, the plastic sheet having a peripheral edge that is secured to one side of the sheet on the opposite side of the drive member from the folded leading edge, the leading edge of the first fin end being spaced forwardly from the lower end of the drive member and the securement of the peripheral edge to one side of the sheet being spaced rearwardly from the lower end of the drive member, said fin having a second end that extends from the first end thereof to provide flexible flapping movement upon oscillation of the drive member so as to propel the water lounge, said first end of the fin defining a generally foil shape that facilitates movement of the lower drive member end through the water as well as rigidifying the fin adjacent the axis of oscillation so as to increase the moment arm about the drive member where the flexible flapping movement of the second fin end is concentrated, the flexible end of the fin having a length between about 1.4 and 1.8 times the length of the foil-shaped end of the fin, and the peripheral edge of the fin being secured to said one side of the fin spaced from the drive member axis of oscillation a distance about 3 times the distance between the folded leading edge of the fin and said axis.

14. In a floatable lounge having a frame and a covering thereover, a water propulsion unit comprising: a vertically extending drive member having upper and lower ends; mounting means including a journal tube that supports the drive member for oscillatory movement about a vertical axis and a mounting bar connected to the journal tube and having a pair of mounts for securing the unit to the lounge frame; a foot operated actuator bar on the upper end of the drive member for providing driving oscillation thereof; and a fin made from a flexible plastic sheet and including a first end which is folded to define an elongated loop that receives the lower end of the drive member in a fixedly secured relationship thereto, a score line in the plastic sheet at which the first end of the fin is folded to provide a leading edge of the fin, the plastic sheet having a peripheral edge that is secured to one side of the sheet on the opposite side of the drive member from the folded leading edge, the leading edge of the first fin end being spaced forwardly from the lower end of the drive member and the securement of the peripheral edge to one side of the sheet being spaced rearwardly from the lower end of the drive member, said fin having a second end that extends from the first end thereof to provide flexible flapping movement upon oscillation of the drive member so as to propel the water lounge, and said first looped end of the fin defining a generally foil shape that facilitates movement of the lower drive member end through the water as well as rigidifying the fin adjacent the axis of oscillation so as to increase the moment arm about the drive member where the flexible flapping movement of the second fin end is concentrated, and the flexible end of the fin having a length between about 1.4 and 1.8 times the length of the foil end of the fin.

15. A unit as in claim 14 wherein the peripheral edge of the plastic sheet is secured to the one side of the sheet spaced from the axis of drive member oscillation a distance equal to about 3 times the distance between the folded leading edge of the fin and said axis.

16. A unit as in claim 1 wherein the trailing junction between the sides of the first foil end is spaced rearwardly from the axis of drive member oscillation a distance equal to about 3 times the distance between the leading junction between the sides thereof and said axis.

* * * * *

UNITED STATES PATENT AND TRADEMARK OFFICE

CERTIFICATE OF CORRECTION

PATENT NO. : 4,172,427

DATED : October 30, 1979

INVENTOR(S) : William B. Kindred

It is certified that error appears in the above-identified patent and that said Letters Patent are hereby corrected as shown below:

Column 5, line 12 "b"(second instance)

should be --d--.

Signed and Sealed this

*Twelfth* Day of *February 1980*

[SEAL]

*Attest:*

SIDNEY A. DIAMOND

*Attesting Officer*

*Commissioner of Patents and Trademarks*